US006388625B1

(12) United States Patent
Fukushima et al.

(10) Patent No.: US 6,388,625 B1
(45) **Date of Patent: *May 14, 2002**

(54) ANTENNA DEVICE AND MOBILE COMMUNICATION UNIT

(75) Inventors: Susumu Fukushima; Naoki Yuda; Masahiro Oohara, all of Osaka (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/424,270

(22) PCT Filed: Mar. 16, 1999

(86) PCT No.: PCT/JP99/01284

§ 371 Date: Jan. 3, 2000

§ 102(e) Date: Jan. 3, 2000

(87) PCT Pub. No.: WO99/48169

PCT Pub. Date: Sep. 23, 1999

(30) Foreign Application Priority Data

Mar. 19, 1998 (JP) ..... 10-070162

(51) Int. Cl.[7] ..... H01Q 1/24; H01Q 1/36
(52) U.S. Cl. ..... 343/702; 343/895
(58) Field of Search ..... 343/702, 895, 343/901; H01Q 1/24, 1/36

(56) References Cited

U.S. PATENT DOCUMENTS 5,559,524 A * 9/1996 Takei et al. ..... 343/895
5,828,342 A * 10/1998 Hayes et al. ..... 343/702
5,923,305 A * 7/1999 Sadler et al. ..... 343/895
5,982,330 A * 11/1999 Koyanagi et al. ..... 343/702
5,999,142 A * 12/1999 Jang ..... 343/895
6,069,592 A * 5/2000 Wass ..... 343/702
6,107,970 A * 8/2000 Holshouser et al. ..... 343/702

FOREIGN PATENT DOCUMENTS

| | | |
|---|---|---|
| JP | 3-236612 | 10/1991 |
| JP | 5-275919 | 10/1993 |
| JP | 9-2476828 | 9/1997 |
| JP | 10-22730 | 1/1998 |
| JP | 10-32410 | 2/1998 |

OTHER PUBLICATIONS

Japanese language search report for Int'l Appln No. PCT/JP99/01284 dated Jun. 15, 1999.

* cited by examiner

*Primary Examiner*—Hoanganh Le
(74) *Attorney, Agent, or Firm*—Ratner & Prestia, P.C.

(57) ABSTRACT

An antenna device used in mobile communication apparatus such as cellular phones, and which achieves good transmission and reception of information in more than one frequency band. Easy and wide ranging adjustment of the impedance properties of the antenna as well as their productive mass production is allowed. The antenna device includes a) a spiral-shaped first antenna element (1) of which one end is open and the other end is electrically connected to a high frequency circuit inside a communication terminal; and b) a second antenna element (2) having both ends being open, and which is insulated from and disposed on either outer or inner surface of the first antenna element (1). The impedance properties of an antenna can be adjusted by changing the disposing position of the second antenna element (2).

30 Claims, 15 Drawing Sheets

890MHz

Radiation efficiency=-0.8dB

960MHz

η=-0.7dB

1710MHz

η=-1.2dB

1880MHz

η=-1.0dB

ANTENNA DEVICE AND MOBILE COMMUNICATION UNIT

THIS APPLICATION IS A U.S. NATIONAL PHASE APPLICATION OF PCT INTERNATIONAL APPLICATION PCT/JP99/01284.

FIELD OF THE INVENTION

The present invention relates to an antenna device achieving desirable transmission and reception in two or more frequency bands, and which is used in mobile communication apparatus such as cellular phones.

BACKGROUND OF THE INVENTION

FIG. 14 shows one example of a conventional antenna device used in mobile communication apparatus such as cellular phones. In FIG. 14, 102 is a transmission and reception unit, and surrounding it is a main housing 101. On the top of the main housing 101 are a pair of antenna coils 103 and 104 which are disposed integrally on the inside of a common housing 110.

The two antenna coils 103 and 104 are disposed on the same axis. The antenna coil 103 placed on the top is connected to a transmission unit 105 of the transmission and reception unit 102 via a duplex filter 107. The antenna coil 104 placed at the bottom is connected to a reception unit 106 of the transmission and reception unit 102 via the duplex filter 107.

The electrical lengths of the two antenna coils 103 and 104 are designed such that the electrical lengths of the top antenna coil 103 and bottom antenna coil 104 are respectively a quarter of the transmission frequency and reception frequency of the transmission and reception unit 102.

The antenna coil 103 for transmission is disposed above the antenna coil 104 for reception. By positioning the antenna coil 103 further from metallic parts or other similar parts of the apparatus, better transmission can be obtained.

The two antenna coils 103 and 104 share a common feed line 108 to the duplex filter 107. The length of a transmission feed line portion 108*a* of the transmission antenna coil 103, which extends via the reception antenna coil 104 is open in the reception band, and is connectable with the duplex filter 107 in the transmission band. In FIG. 14, 109 is a second reception antenna.

Therefore, when the reception antenna coil 104 is used, the transmission antenna coil 103 does not place any load on the junction point, thus only the reception antenna coil 104 is driven. The antenna coils 103 and 104 are designed to match at 50 ohms so that impedance matching is not required.

With the above-mentioned conventional construction however, when trying to obtain the optimal impedance properties of the antenna, relative positions of the two antenna coils can not be changed and possible range for impedance adjustment is limited since the two antenna coils are both supplied with electricity and fixed.

Therefore, when the impedance for the antenna terminals of the duplex filter is changed due to a design change of a high frequency circuit inside the apparatus, the antenna device itself requires a design modification to deal with changed impedance. As such, rapid countermeasures to the design change of the apparatus are difficult to implement.

To mass-produce the device, the two antenna coils must be disposed, maintaining their relative positions precisely so that dispersion of the impedance of the antenna device does not occur. At the same time, the two antenna coils must be electrically connected to the high frequency circuit inside the apparatus. Thus, with this construction it is difficult to mass-produce the device productively.

The present invention aims at providing antenna devices and mobile communication apparatus using the devices, which allow an easy and wide-ranging adjustment of the impedance properties of the antenna as well as mass production of related products with good yield.

SUMMARY OF THE INVENTION

An antenna device of the present invention includes a) a spiral-shaped first antenna element of which one end is open and the other end is electrically connected with a high frequency circuit inside of a communication terminal; and b) a second antenna element having both ends being open, and which is insulated from and disposed on either outer or inner surface of the first antenna element. The impedance properties of an antenna can be adjusted by changing the disposing position of the second antenna element. Desired impedance properties can be gained just by changing the disposing position. A wide range adjustment of the impedance properties is also possible. Moreover, the construction of the antenna device is remarkably simple, thus its mass-production is easy.

DESCRIPTION OF THE PREFERRED EMBODIMENTS

Figure 1:
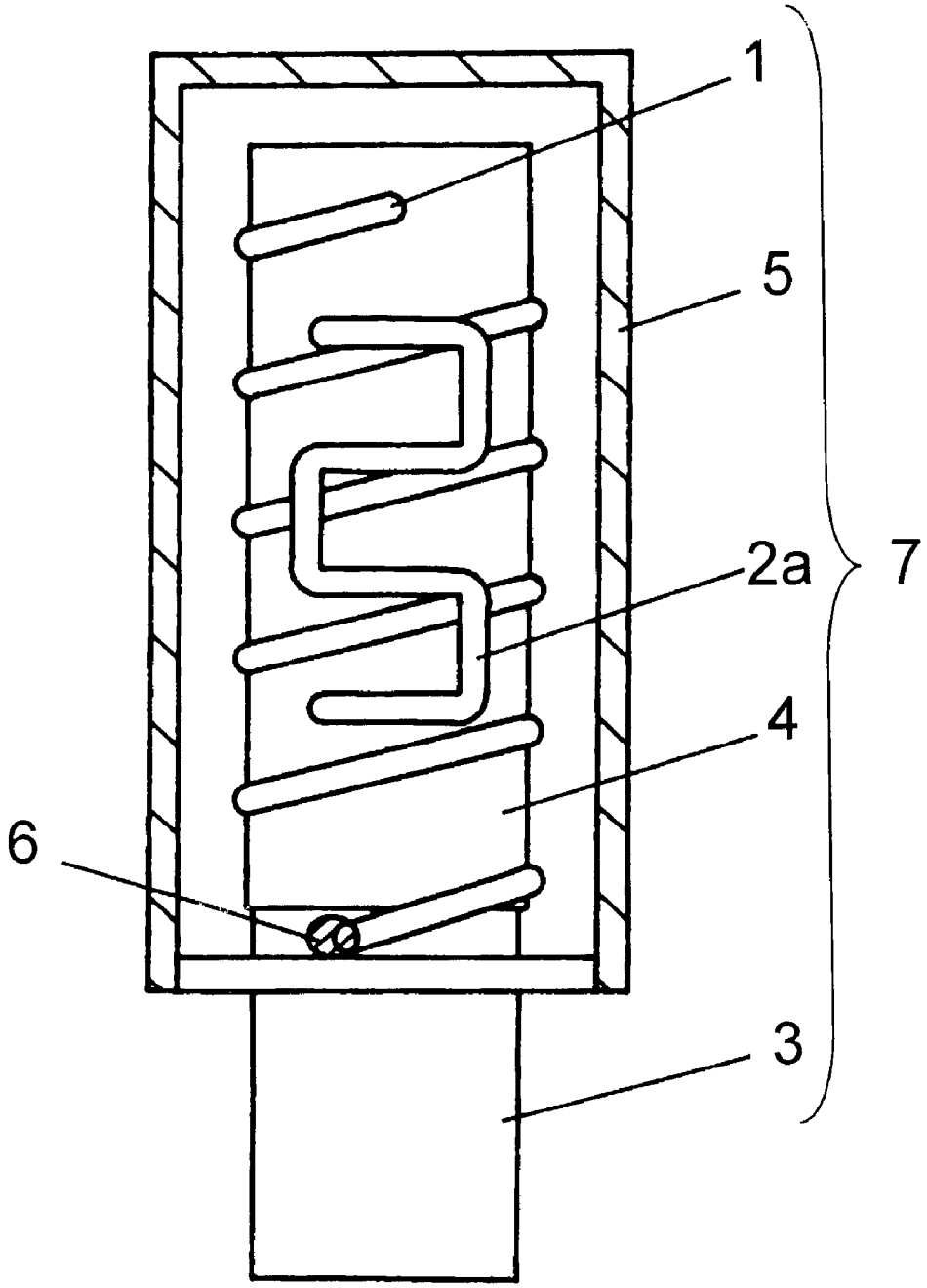
FIG. 1 shows a cross section of a main part of an antenna device according to a first exemplary embodiment of the present invention.

An antenna device of an embodiment of the present invention includes a spiral-shaped first antenna element, of which one end is open and the other end is electrically connected to a high frequency circuit inside a communication terminal. The antenna device also includes a second antenna element, both ends of which are open, and which is insulated and disposed on the outer or inner surface of the first antenna element. The impedance properties of the antenna can be adjusted by changing the position of the second antenna element. By changing the sizes and relative positions of both antenna elements, optimal impedance properties of the housing where the antenna elements are mounted can be realized easily. The antenna is constructed in such a manner that the second antenna element is insulated and fixed to the outer surface of the first antenna element. Thus, positions of both antenna elements can be determined relatively easily. These characteristics allow realization of an antenna construction suitable for mass production.

An antenna device of another embodiment of the present invention has a first antenna element and a second antenna element of which the respective electrical length resonate in a first frequency band and a second frequency band. The first antenna element is constructed to have an electrical length of a quarter or a half the wavelength of the first frequency. The second antenna element is constructed to have an electrical length of a half the wavelength of the second frequency. With this construction, a compact antenna which achieves a desirable transmission and reception in dual frequency bands can be realized.

An antenna device of yet another embodiment of the present invention has a characteristic of a higher second frequency band than a first frequency band, which is realized by setting the electrical length of a second antenna element shorter than that of a first antenna element. The length of the element of the second antenna element which is insulated and fixed on the outer surface of the spiral-shaped first antenna element can be shortened. Therefore, the second antenna element can achieve a wider degree of freedom in its disposing position.

An antenna device of yet another embodiment of the present invention has a characteristic of a lower second frequency band than the first frequency band, which is realized by setting the electrical length of a second antenna element longer than that of a first antenna element. Since the length of the element of the spiral-shaped first antenna element can be shortened, the pitch of the spiral element can be widened. Therefore, the first frequency band can be further widened.

An antenna device of yet another embodiment of the present invention has a second antenna element made of a conductive lead, which is insulated and disposed on the outer or inner surface of a first antenna element in such a manner that the conductive lead is parallel to the central axis of the spiral-shaped first antenna element. By changing the length and the position of the element of the second antenna element, the impedance properties of the antenna device can be adjusted.

An antenna device of yet another embodiment of the present invention has a second antenna element made of a conductive lead, which is insulated and disposed on the outer or inner surface of a first antenna element perpendicularly to the central axis of the spiral-shaped first antenna element. When the diameter of the first antenna element is large, the length of the element of the second antenna element can be further extended. Thus the second frequency band can be set even lower.

An antenna device of yet another embodiment of the present invention has a second antenna element made of a conductive lead, which is insulated and disposed on the outer or inner surface of a first antenna element such that it has an arbitrary angle to the central axis of the spiral-shaped first antenna element. Thus, the degree of electrical connection between the first and second antenna elements can be changed remarkably. For example, by insulating and disposing the second antenna element on the first antenna element, the electrical connection between them can be intensified, thereby allowing even more current to flow to the second antenna element.

An antenna device of yet another embodiment of the present invention has a second antenna element made of a plurality of conductive leads, which is insulated and disposed on the outer or inner surface of a first antenna element such that at least two conductive leads are electrically connected at a predetermined angle to each other. The electrical length of the second antenna element can be set long. Thus, an antenna device which allows a wide adjustable impedance range can be realized.

An antenna device of yet another embodiment of the present invention has a second antenna element made of a plurality of conductive leads, which is insulated and disposed on the outer or inner surface of a first antenna element such that at least one conductive lead is electrically connected at a predetermined angle to each of a plurality of conductive leads at a plurality of places. A dual frequency antenna circuit having high sensitivity in a wider band can be realized by having "n" conductive lines functioning as a matching circuit of the antenna circuit.

An antenna device of yet another embodiment of the present invention has a second antenna element with a meandering shaped conductive section. The conductive section is insulated and disposed on the outer or inner surface of a first antenna element. By adjusting stray capacitance between meandering sections of the elements, the electrical length of the second antenna element can be extended. In short, the same amount of electrical length can be obtained with a shorter antenna element. Thus, a smaller and lighter antenna device can be achieved.

An antenna device of yet another embodiment of the present invention has a second antenna element made of a conductive plate. The conductive plate is insulated and disposed on the outer or inner surface of a first antenna element. By changing wiring positions and size of the conductive plate, it is possible to match the conductive plate with a high frequency circuit inside an information terminal.

An antenna device of yet another embodiment of the present invention has a second antenna element made of a conductive plate which is longer than either half of the outer or inner circumference of a first antenna element. The conductive plate is insulated and disposed along the outer or inner surface of a first antenna element. The second antenna element can be easily fixed at an arbitrary position on the first antenna element. Thus, an antenna construction which facilitates easy mass production can be achieved.

An antenna device of yet another embodiment of the present invention has a second antenna element made of a ring whose inner diameter is larger than the outer diameter of a first antenna element, or the outer diameter smaller than the inner diameter of the first antenna element. The ring is insulated and disposed on the outer surface of the first antenna element. By moving the conductive ring upward or downward, the impedance, of the antenna device can be easily changed.

An antenna device of yet another embodiment of the present invention uses a plurality of second antenna elements which are disposed on a first antenna element. Electromagnetic coupling between the second antenna elements extends the electrical length as well as increasing the number of size parameters of the antenna device.

An antenna device of yet another embodiment of the present invention has first and second antenna elements made of at least one of the following materials; silver, copper, beryllium bronze, phosphor bronze, brass, aluminum, nickel or steel. An appropriate metal(s) to the required properties of the antenna is selected when designing the antenna. For example, when the radiation characteristic is prioritized, silver which is highly conductive is a desirable metal. If rigidity is the most important property, appropriate metals are beryllium bronze and phosphor bronze.

An antenna device of yet another embodiment of the present invention has first and second antenna element plated with at least one of the following metals; silver, copper, beryllium bronze, phosphor bronze, brass, aluminum, nickel or steel. Even if low-conductive metal(s) is used for the antenna element, it can maintain conductivity as high as silver just by plating the surface of the antenna element with a highly conductive metal such as silver. In this case, the thickness of the plating is calculated based on the frequency at which the antenna device is used. Moreover, degradation of the conductivity can be prevented by plating the antenna elements with a corrosion-free metal(s).

An antenna device of yet another embodiment of the present invention has first and second antenna elements, the cross sections of which are approximately circular or polygonal. If a thin flat-type wire is used for the antenna elements, the diameter of the spiral-shaped first antenna element can be expanded, thereby broadening the frequency band.

An antenna device of yet another embodiment of the present invention has first and second antenna elements which are insulated from each other by means of resin molding. The whole body of the first antenna element is molded with resin material in order to insulate it from the second antenna element and to increase the mechanical strength of the antenna against such accidents as dropping in the case of a cellular phone.

An antenna device of yet another embodiment of the present invention includes first and second antenna elements at least one of which is coated with insulative film on the surface. This construction allows omission of the process to provide insulation between the first and second antenna elements. At the same time, the gap between the first and second antenna element can be narrowed significantly. Therefore, the degree of electrical coupling between the two antenna elements can be enhanced. Moreover, the diameter of the first antenna element can be extended to the largest extent within the limited space provided for the antenna in a cellular phone.

An antenna device of yet another embodiment of the present invention has a first antenna element of which the outer or inner surface is molded with resin, and on the surface of the resin, a pattern of the second antenna element is formed by plating. The insulation between the first and second antenna elements is realized by molding the whole body of the first antenna element with resin material. By this method, the mechanical strength of the antenna against such accidents as dropping in the case of a cellular phone is enhanced. Furthermore, the second antenna element has less position dispersion since the pattern of the second antenna element is formed by plating. Thus, an antenna device with less variation in electrical properties can be achieved.

An antenna device of yet another embodiment of the present invention has a pattern of a second antenna element formed onto a film or a flexible thin film resin by plating, which wraps and is fixed to a spiral-shaped first antenna element, while maintaining insulation from the first antenna element. The gap between the first and second antenna elements can be controlled by changing the thickness of the film or flexible thin film resin. At the same time, by being able to arbitrarily change the attachment position, the disposing position of the second antenna element can be adjusted flexibly according to the impedance properties of the high frequency circuit.

An antenna device of yet another embodiment of the present invention has a pattern of a second antenna element formed by printing conductive paste onto a film or flexible thin film resin, and which wraps and is fixed to a spiral-shaped first antenna element, while maintaining insulation from the first antenna element. Press and plating processes are not necessary, thus low-cost production of antenna devices is possible.

An antenna device of yet another embodiment of the present invention has a second antenna element insulated from and disposed to the inner surface of the spiral-shaped first antenna element. With this construction, the diameter of the first antenna element can be extended by the amount of thickness of the second antenna element wire as well as the width of the gap between the first and second antenna elements, which is needed to insulate the two elements. Thus, it is possible to further broaden the frequency band.

An antenna device of yet another embodiment of the present invention has the following three antenna elements:

1) a spiral-shaped first antenna element of which one end is open and the other end is electrically connected to a high frequency circuit in a communication terminal;
2) a second element with both ends being open, and which is insulated from and disposed on the outer or inner surface of the first antenna element; and
3) a third antenna element placed such that it can slide inside the first antenna element. When the third antenna element is extended, electricity is supplied only to the third antenna element, when the third antenna element is stored, electricity is supplied only to the first antenna element. Sizes and relative positions of the first and second antenna elements can be adjusted so that the impedance properties of the antenna device when the third antenna element is extended and stored can be almost the same within the predetermined frequency band. Thus, high radiation characteristics can be achieved.

An antenna device of yet another embodiment of the present invention has the following three antenna elements:

1) a spiral-shaped first antenna element of which one end is open and the other end is electrically connected to a high frequency circuit in a communication terminal;
2) a second element with both ends being open, and which is insulated from and disposed on the outer or inner surface of the first antenna element; and
3) a third antenna element placed such that it can slide inside the first antenna element. When the third antenna element is extended, electricity is supplied only to the first and the third antenna elements, when the third antenna element is stored, electricity is supplied only to the first antenna. The structure in the joint section between the high frequency circuit in the information terminal and the antenna device can by simplified. Thus, easy-to-produce, low-cost antenna construction can be achieved.

An antenna device of yet another embodiment of the present invention has following three antenna elements:

1) a spiral-shaped first antenna element of which one end is open and the other end is electrically connected to a high frequency circuit in a communication terminal;
2) a second element with both ends being open, and which is disposed on the outer or inner surface of the first antenna element while maintaining insulation from it or conductivity with it; and
3) a third antenna element having the first and second antenna elements integrally formed on the top, and is disposed such that it can slide inside the housing of the communication terminal. When the third antenna element is extended, electricity is supplied only to the third antenna element, when the third antenna element is stored, electricity is supplied only to the first antenna. The electromagnetic coupling between the first, second and third antenna elements can be reduced, thereby simplifying the design of the antenna. Moreover, the electrical length of the third antenna element when it is extended becomes longer due to the first and second antenna elements which are insulated from and disposed vertically to the third antenna element. Thus, radiation resistance of the antenna device when the antenna is extended can be intensified.

An antenna device of yet another embodiment of the present invention includes a stick-type third antenna element. With this construction, the antenna can be placed further away from the head of a user, thereby reducing possible influences on the brain. By this method, radiation efficiency of the antenna during use can be improved.

An antenna device of yet another embodiment of the present invention has a third antenna element which has a spiral-shaped element. For this construction, the third antenna element gains flexibility, thus an antenna remarkably tolerant to bending stress can be realized. Shrinking of the length of the third antenna element is also possible.

An antenna device of yet another embodiment of the present invention has first and second antenna elements integrally incorporated into the inside of the communication terminal. This construction realizes a cellular phone with superior design. Moreover, the mechanical strength of the antenna is enhanced against such accidents as dropping the cellular phone.

A detailed description of the embodiments of the present invention is provided hereinafter, with reference to the drawings.

FIRST EXEMPLARY EMBODIMENT

FIG. 1 shows a cross section of a main part of an antenna device according to the first exemplary embodiment of the present invention. This antenna device for cellular phones allow desirable transmission and reception of the communication in dual frequency bands. In FIG. 1, a first antenna element 1 is formed by spirally winding a conductive wire on a core rod 4 made of insulative resin. At the bottom tip of the spiral-shaped first antenna element 1 is a metallic plug 3 made of copper or copper compounds for electrically connecting a high frequency circuit inside the cellular phone. One end of the spiral conductive wire is soldered and fixed to form a connecting section 6.

By electrically connecting the metallic plug 3 and the high frequency circuit inside the cellular phone, signals are sent to the first antenna element 1.

A second antenna element 2*a* is made of a conductive material on the surface of which is coated with insulative material. The electrical length of the meandering-shaped second antenna element 2*a* is a half the wavelength of one of the frequencies. The second antenna element is disposed on the predetermined position on the first antenna element 1 so as to gain the desirable impedance properties.

Figure 2:
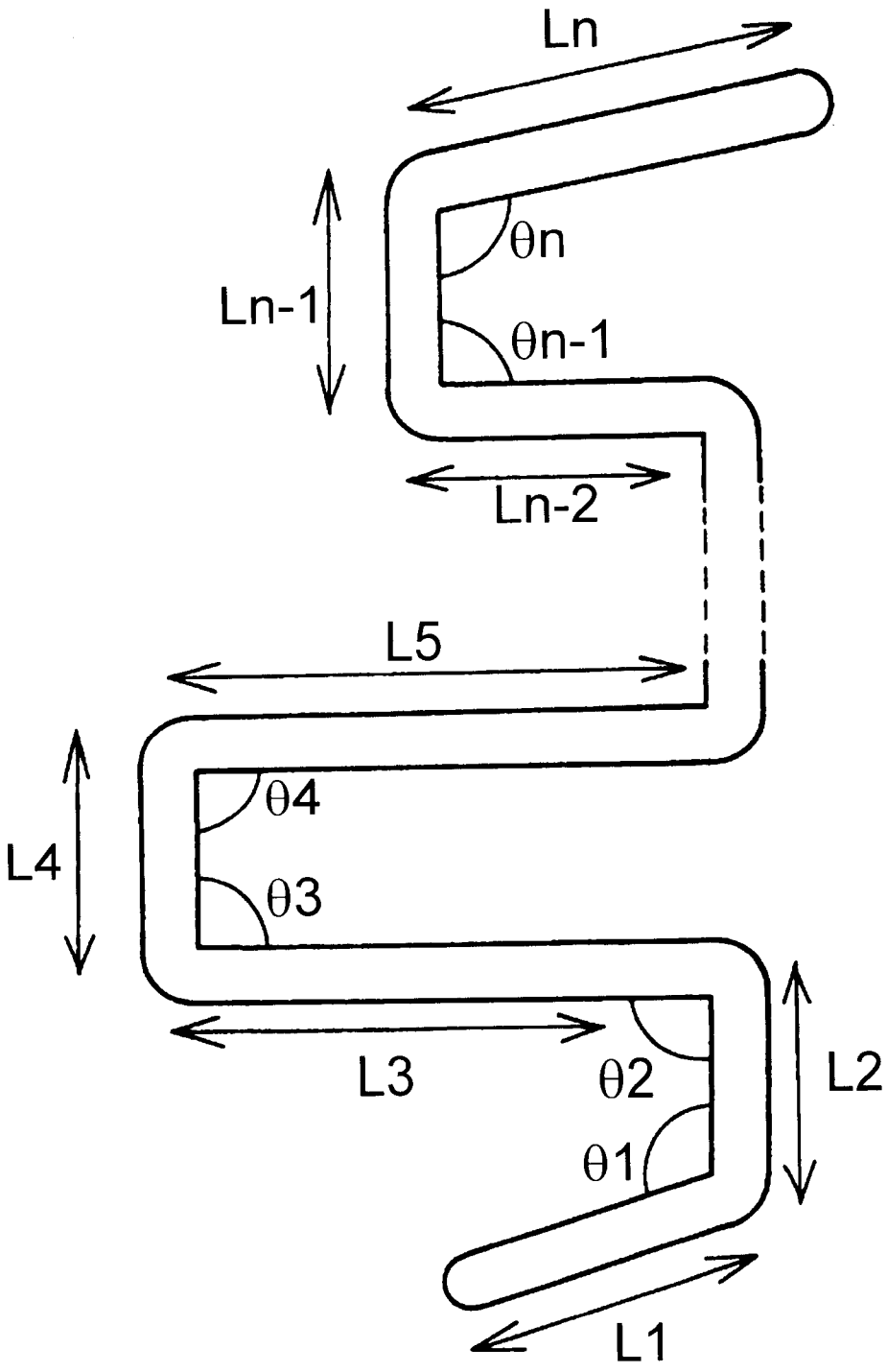
FIG. 2 shows the shape of a meandering antenna element of the antenna device.

The meandering shape of the second antenna element 2*a* means, as described in FIG. 2, a shape constructed by angles from θ1 to θn having arbitrary angles between 0 and 180 and from Ll to Ln of arbitrary length.

A cap 5 is disposed to cover the whole bodies of the first and second antenna element 1 and 2*a* and part of the metallic plug 3 for reasons of mechanical strength and outer appearance. The cap 5 also covers the section which is not stored in the housing of the cellular phone. In the description below, the components mentioned above are lumped together and called a first antenna device 7.

Figure 3:
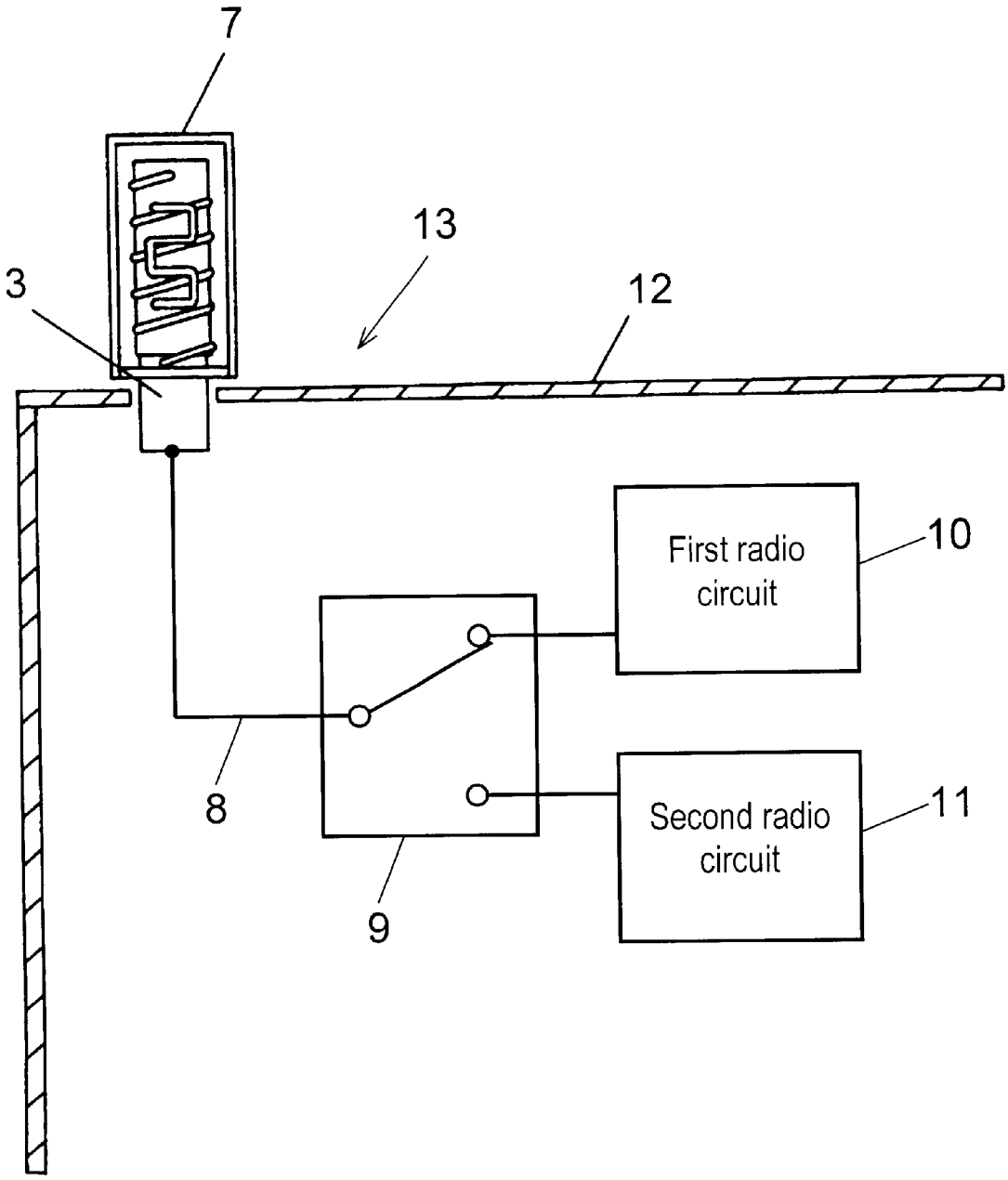
FIG. 3 shows a circuit diagram of the antenna device attached to a radio apparatus.

FIG. 3 is a circuit diagram of the first antenna device 7 attached to a housing 12 of a cellular phone 13. The first antenna device 7 is disposed and fixed to the housing 12 made of insulative resin of the cellular phone 13. The metallic plug 3 is connected to a switch 9 inside the cellular phone 13 by a feeder line 8, and via the switch 9, the metallic plug 3 is connected to a first radio circuit 10 operable at frequency band A and a second radio circuit 11 operable at frequency band B. This construction allows the cellular phone 13 to work in two different frequency bands.

Figure 4A:
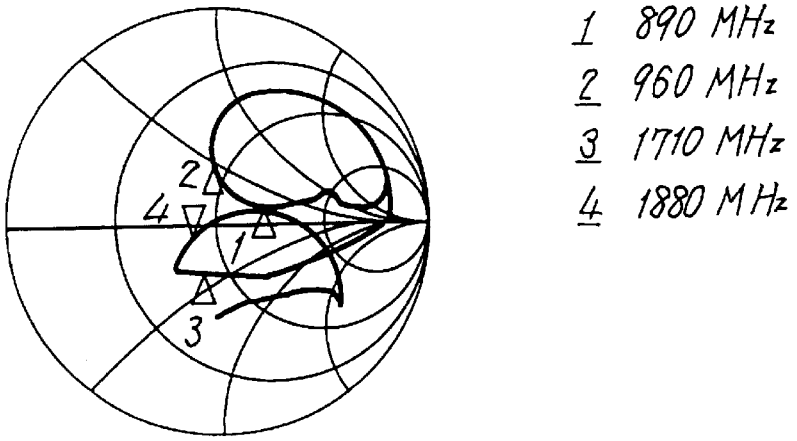
FIGS. 4A and 4B shows properties of the antenna device.
Figure 4B:
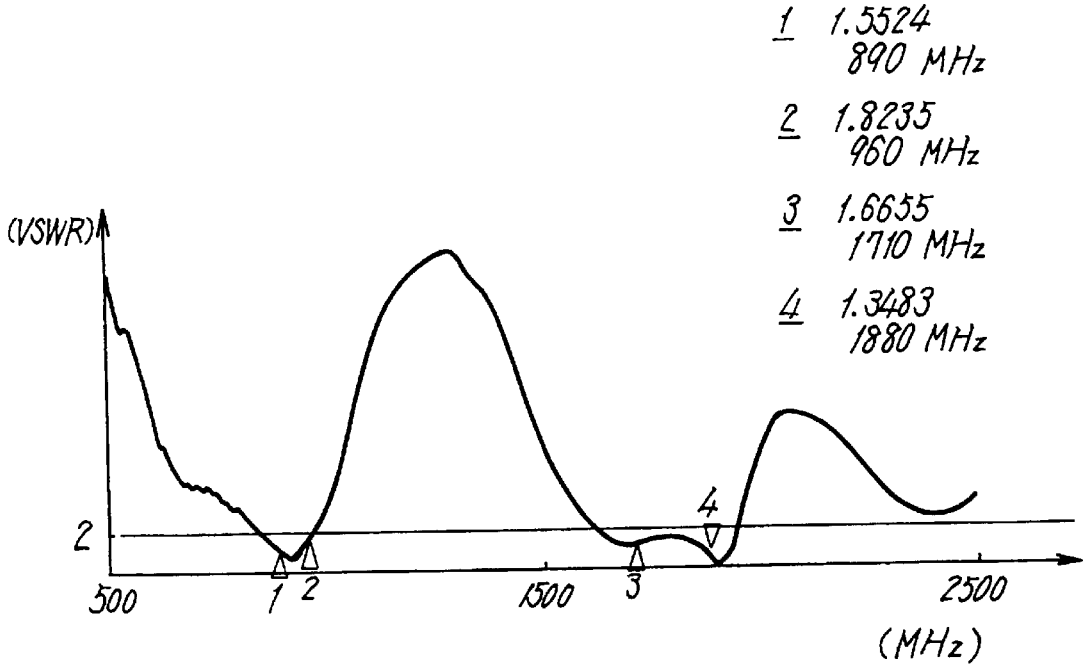
Figure 5A:
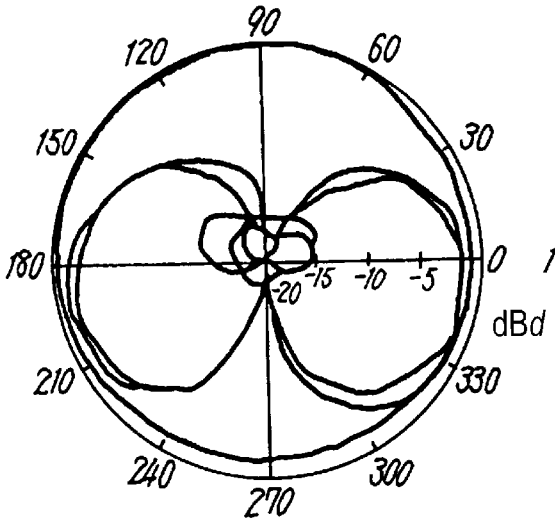
FIGS. 5A–5D show radiation patterns of the antenna device.
Figure 5B:
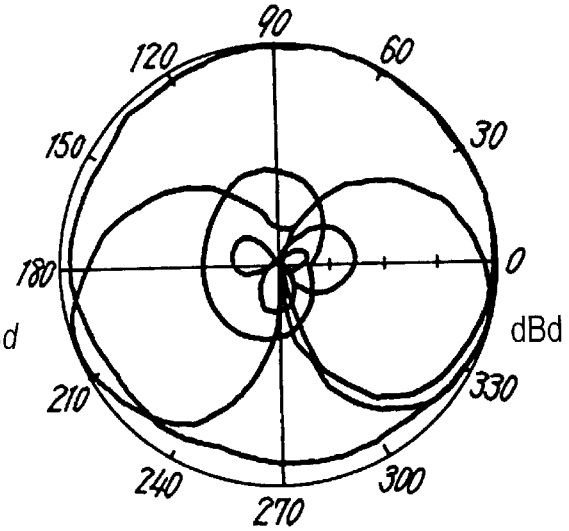
Figure 5C:
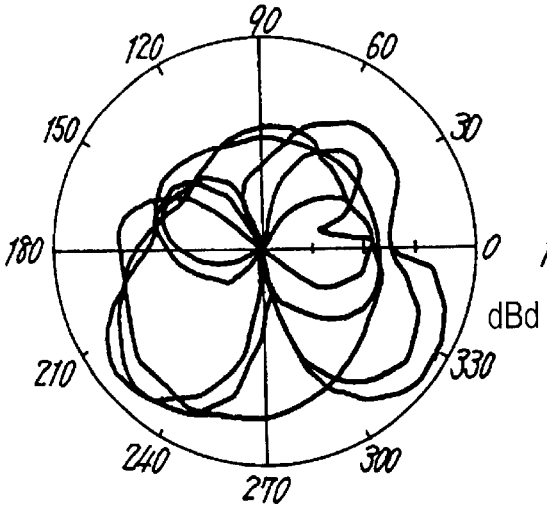
Figure 5D:
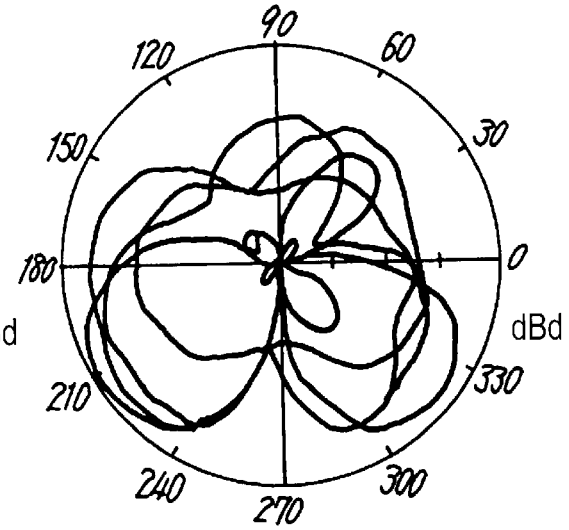

FIG. 4 shows the impedance properties and VSWR properties of the antenna. The antenna is designed as a dual frequency band antenna of GSM (890–940 MHz)/PCN (1710–1880 MHz). As it is clearly shown in FIG. 4, VSWR<2 is realized in all the desired frequencies, providing a remarkable radiation efficiency.

Needless to say, the antenna construction of this embodiment allows the other dual frequency antennas apart from GSM/PCN such as AMPS (824–894 MHz)/PCS (1850–1990 MHz) to achieve VSWR<2.

FIG. 5 shows the radiation patterns of the antenna. Frequencies are set at 890 M, 960 M, 1719 M and 1880 MHz respectively representing frequencies at both ends of the GSM band and PCN band.

The radiation efficiency η is −2 dB and over when calculated from each radiation pattern, thus establishing that an antenna device with remarkable radiation efficiency is achieved.

SECOND EXEMPLARY EMBODIMENT

Figure 6:
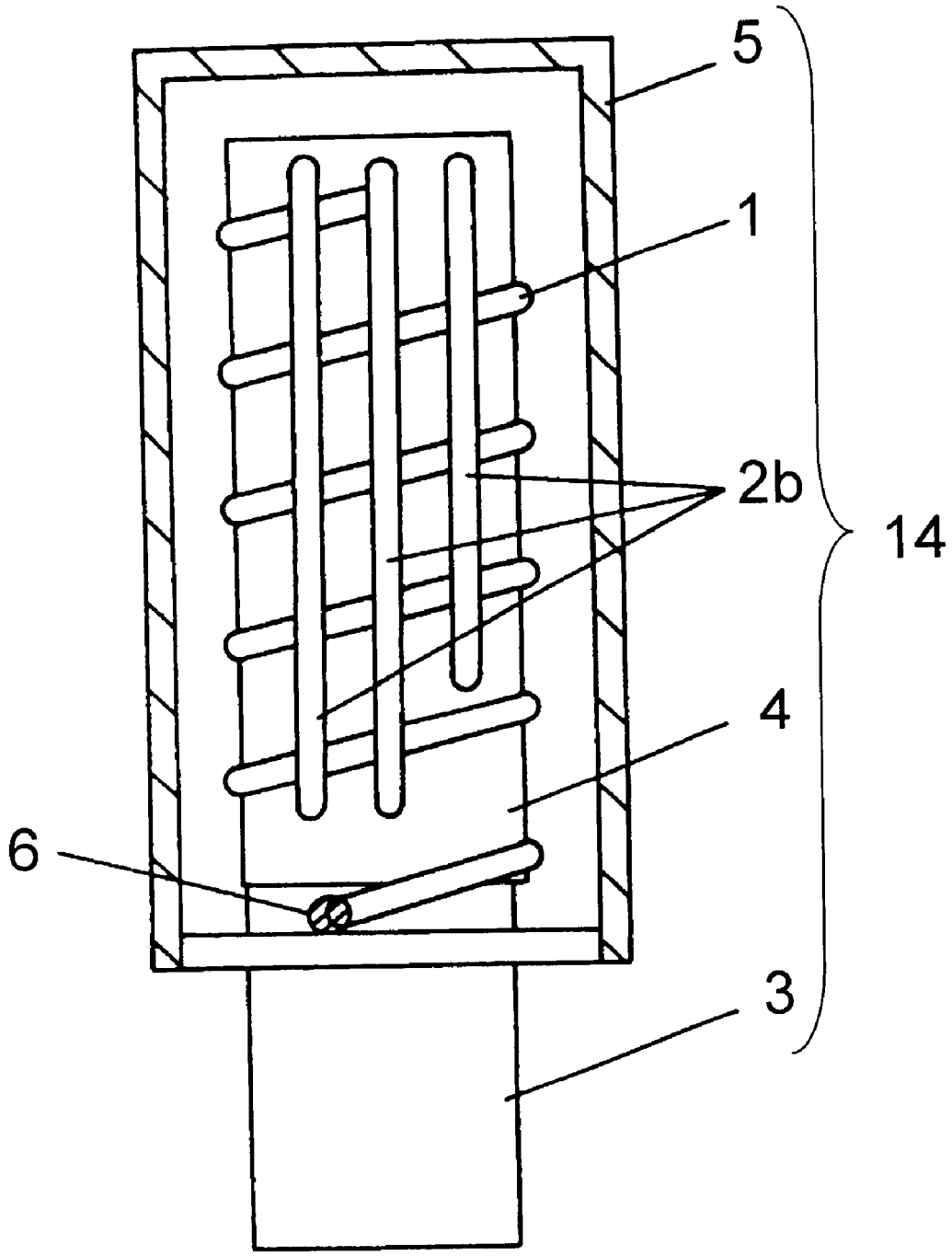
FIG. 6 shows a cross section of a main part of an antenna device according to a second exemplary embodiment of the present invention.

FIG. 6 shows a cross section of the main parts of the antenna device of the second embodiment of the present invention. The same constructions in the first embodiment carry the same numbers and their explanation is omitted.

The construction which is different from that of the first embodiment is the construction of a second antenna element 2*b* which forms a second antenna device 14. As shown in FIG. 6, the second antenna element 2*b* is formed with three straight conductive wires having an insulative film layer on the surface thereof. The disposing position of the second antenna element 2*b* is adjusted on the first antenna element 1 such that the desired impedance properties are gained, thereby realizing good transmission and reception in two frequency bands.

The impedance properties as the second antenna device 14 can be adjusted by changing the length of each of the three straight conductive wires and the distance between them.

THIRD EXEMPLARY EMBODIMENT

Figure 7:
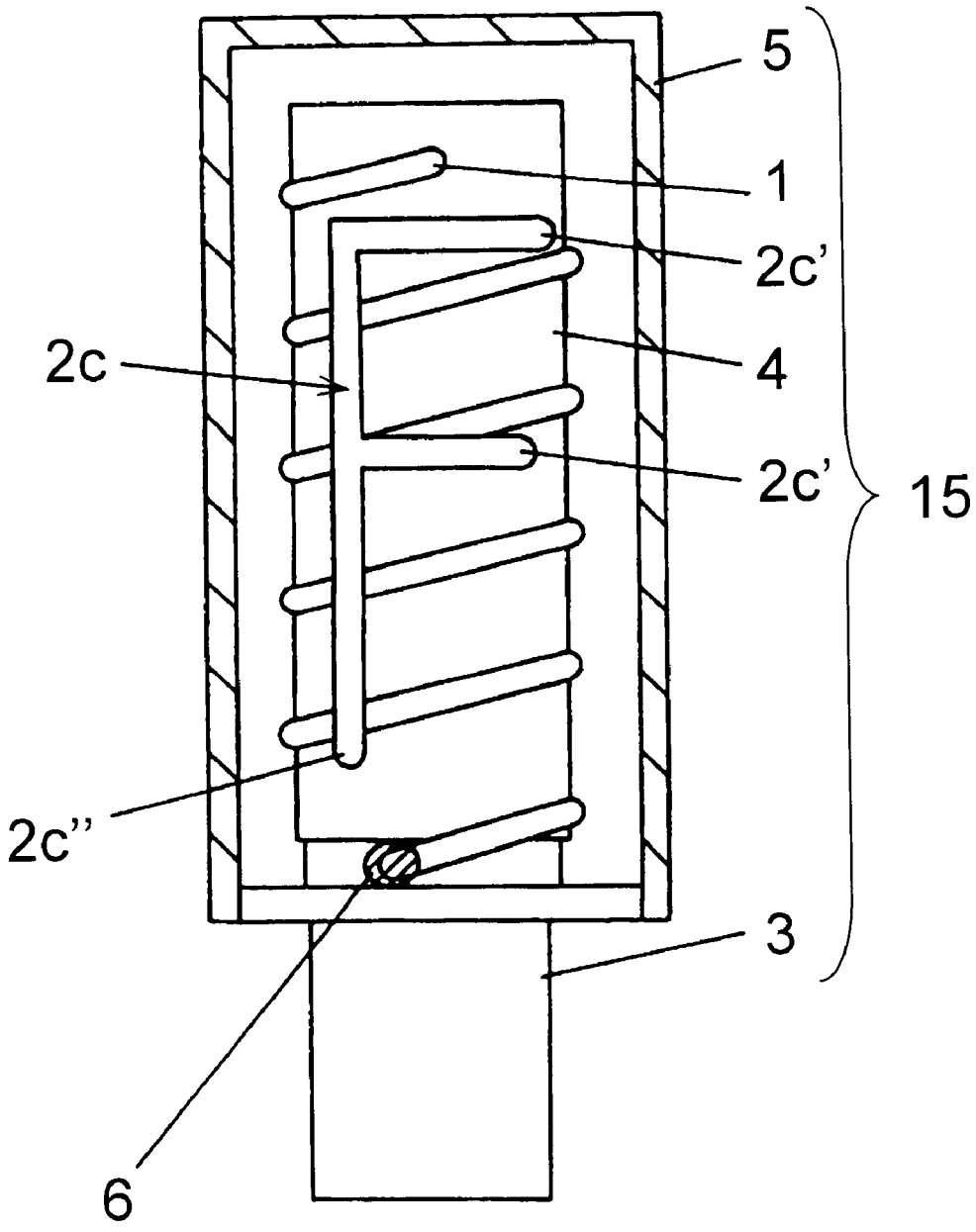
FIG. 7 shows a cross section of a main part of an antenna device according to a third exemplary embodiment of the present invention.

FIG. 7 shows a cross section of the main parts of the antenna device of the third embodiment of the present invention. The same constructions appearing in the first embodiment carry the same numbers and their explanation is omitted.

In this embodiment, a F-shaped second antenna element 2*c* having an insulative film layer on the surface thereof is disposed on a particular part of the spiral-shaped first antenna element 1 wherefrom desirable impedance properties can be obtained. With this construction good transmission and reception of the information in dual frequency bands can be achieved.

The impedance properties of the third antenna device 15 can be adjusted by changing the length of sections of the element 2*c*' on the lateral axis or the intersection points with an longitudinal element 2*c*″.

FOURTH EXEMPLARY EMBODIMENT

Figure 8:
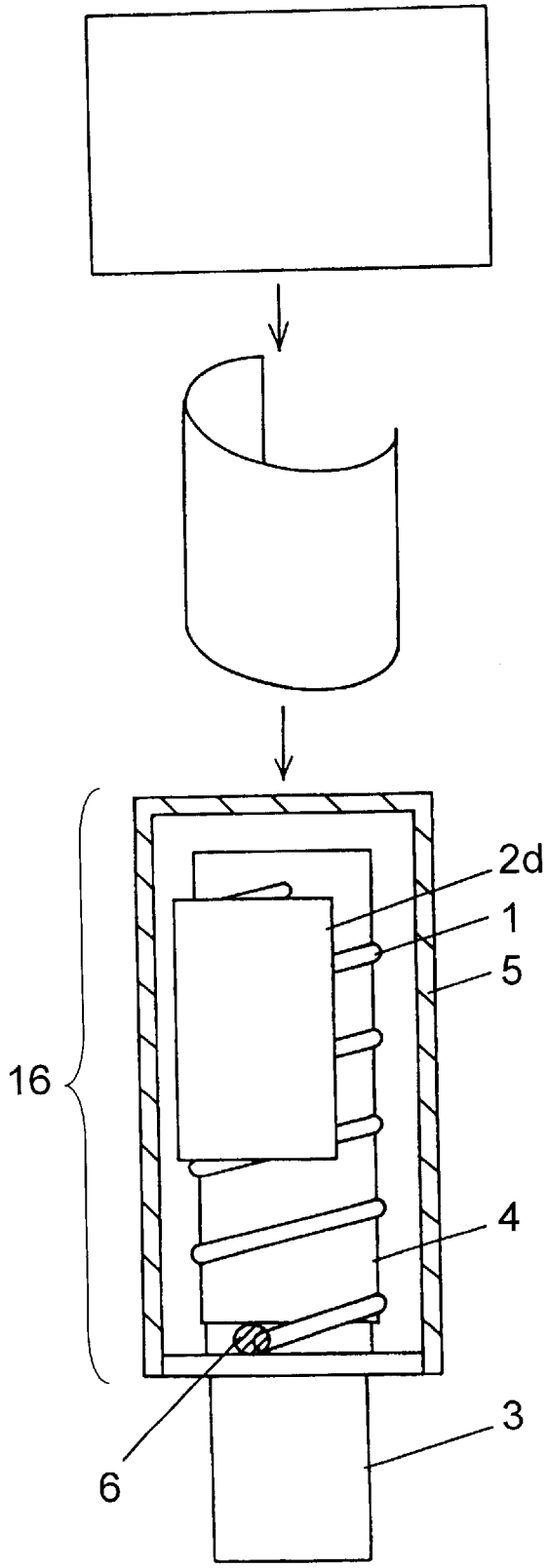
FIG. 8 shows diagrams illustrating a construction of an antenna device according to a fourth exemplary embodiment of the present invention.

FIG. 8 shows a cross section of the main parts of the antenna device of the fourth embodiment of the present invention. The same constructions appearing in the first embodiment carry the same numbers and their explanation is omitted.

In this embodiment a second antenna element 2*d* is formed with a conductive plate having the same R-shape as the outer periphery of the first antenna element 1 shown in the second embodiment. The second antenna element 2*d* is disposed and fixed to the position on the outer periphery of the first antenna element 1 wherefrom desirable impedance properties can be obtained. With this construction, good transmission and reception of the information is possible in dual frequency bands.

The second antenna element 2 can be disposed easily, thus realizing a low cost production of a fourth antenna device 16.

FIFTH EXEMPLARY EMBODIMENT

Figure 9:
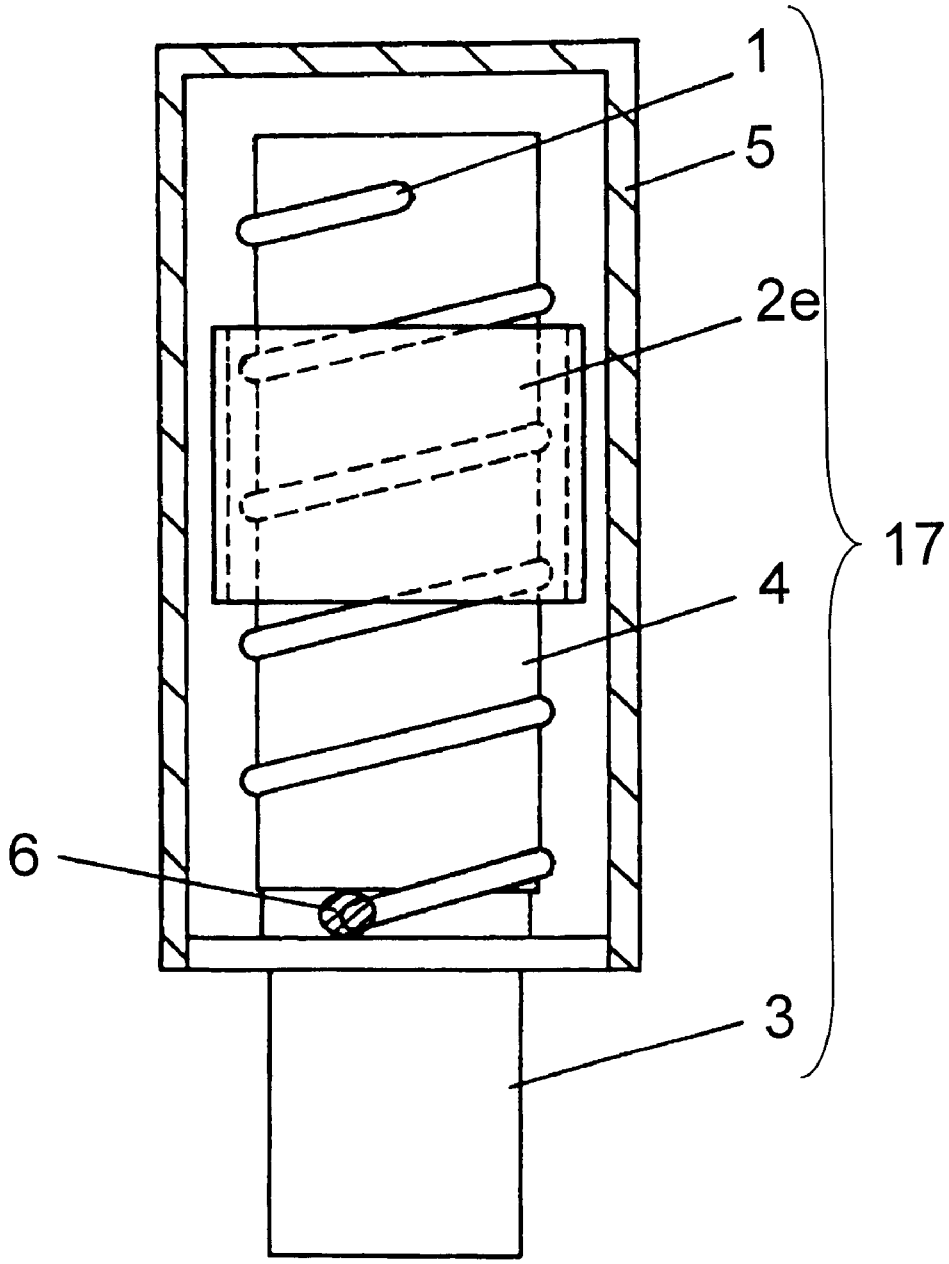
FIG. 9 shows a cross section of a main part of an antenna device according to a fifth exemplary embodiment of the present invention.

FIG. 9 shows a cross section of the antenna device of the fifth embodiment of the present invention. The same constructions appearing in the first embodiment carry the same numbers and their explanation is omitted.

In this embodiment a ring-shaped second antenna element 2*e* having an insulative film layer on the surface thereof is disposed from above the spiral-shaped first antenna element 1 to the position on the first antenna element 1 wherefrom desirable impedance properties can be obtained. With this construction, a fifth antenna device 17 achieves good transmission and reception of the information in dual frequency bands.

In this embodiment, the ring-shaped conductive body is used as the second antenna element 2*e*. However, the second antenna element 2*e* can be formed by plating or printing a ring-shaped element pattern on the inside the cap 5.

SIXTH EXEMPLARY EMBODIMENT

Figure 10:
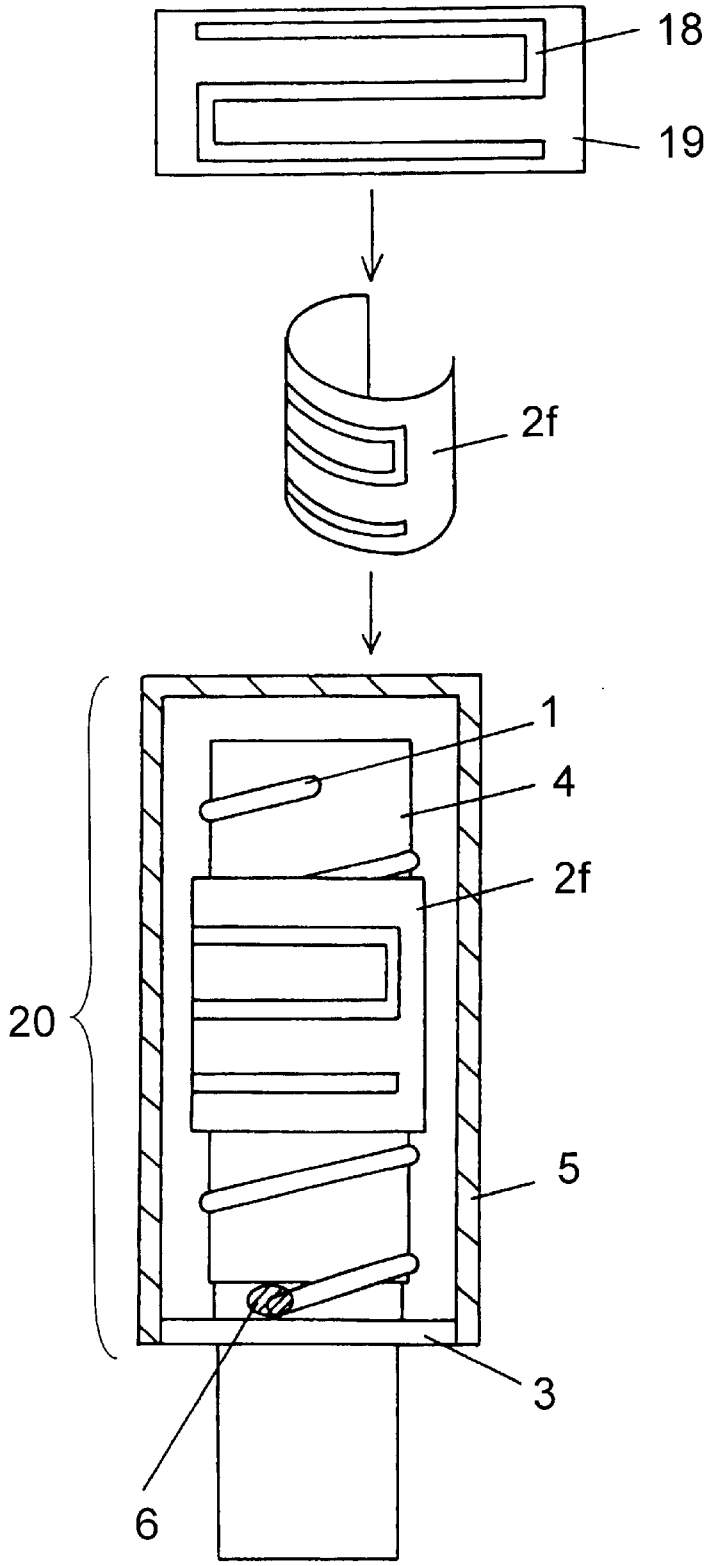
FIG. 10 shows diagrams illustrating a construction of an antenna device according to a sixth exemplary embodiment of the present invention.

FIG. 10 shows a cross section of the antenna device of the sixth embodiment of the present invention. The same constructions appearing in the first embodiment carry the same numbers and their explanation is omitted.

In this embodiment, a second antenna element 2*f* is configured by rolling up a meandering plated pattern 18 formed on a film 19. The second antenna element 2*f* is disposed and fixed to an appropriate position on the spiral-shaped first antenna element 1 shown in the second embodiment to gain desirable impedance properties. With this construction, a sixth antenna device 20 which achieves good transmission and reception of information in dual frequency bands is realized.

The gap between the first antenna element 1 and second antenna element 2*f* is firmly maintained due to the thickness of the film 19. Thus, production of superior antennas with little less variation in electrical properties is possible.

SEVENTH EXEMPLARY EMBODIMENT

FIGS. 11A, 11B, 11C and 11D show a cross section of the antenna device of the seventh embodiment of the present invention. In this embodiment, the core rod 4 in the first antenna device 7 in the first embodiment has a tube-shape, and the cap 5 of the same embodiment has a hole at the top. This construction allows a bar-shaped third antenna element 25 to be freely pulled up and pushed down. The metallic plug 3 has a screw structure at the bottom which is screwed into the top of the housing 12 to gain electric connection with a second feeding point 26.

A third antenna element 25 the top end of which is open, has a first contact point 28 at the bottom, a second contact point in the middle, and a top section 21 made of insulative resin at the top. Apart from these three points, the third antenna element 25 is coated with insulative bodies 22 and 24.

Figure 11A:
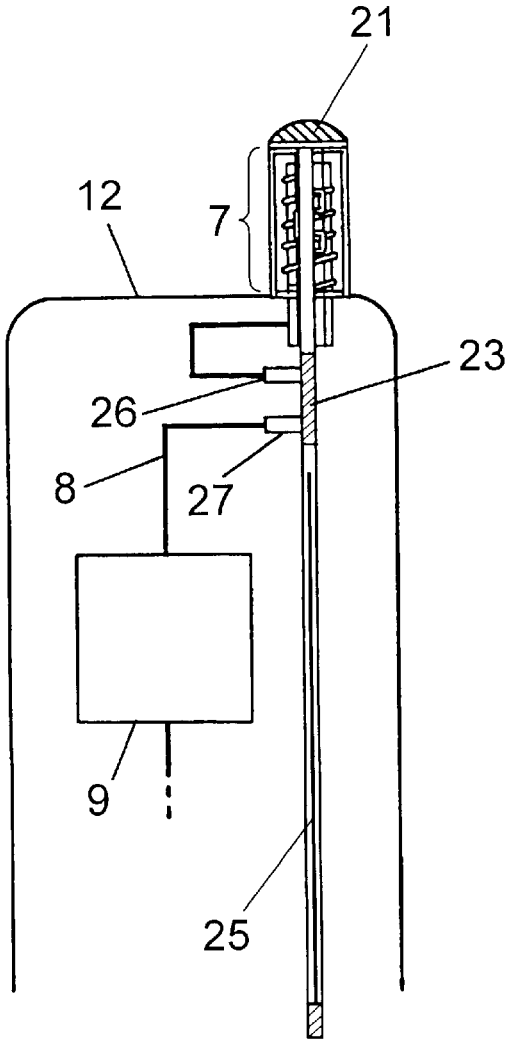
FIGS. 11A, 11B, 11C and 11D show cross sections of a main part of an antenna device according to a seventh exemplary embodiment of the present invention.
Figure 11B:
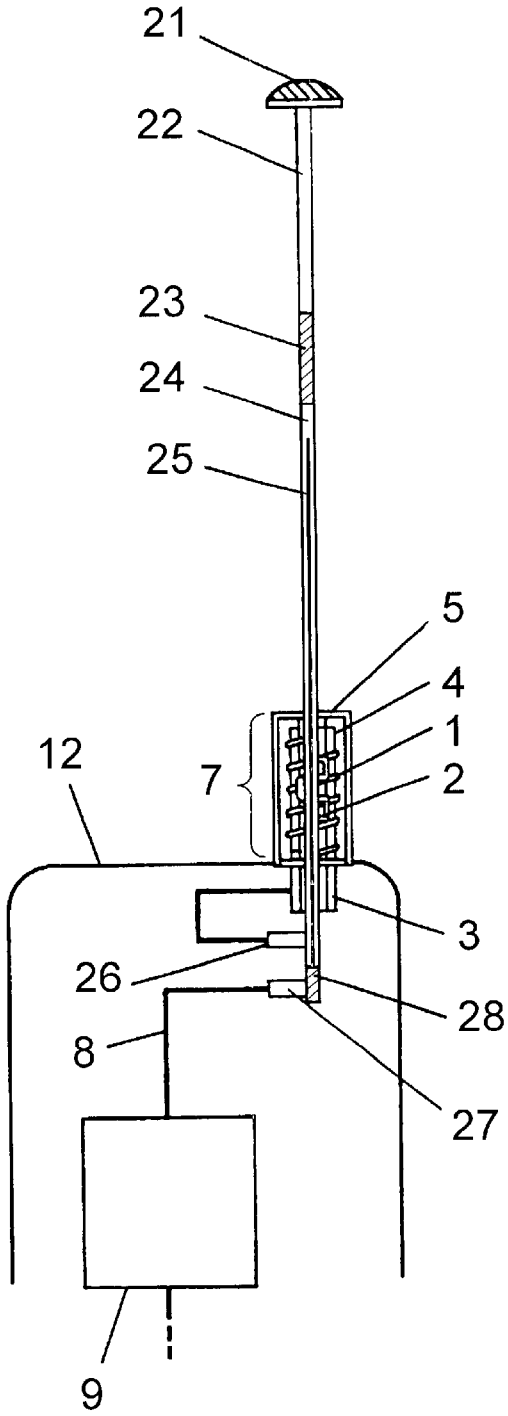
Figure 11C:
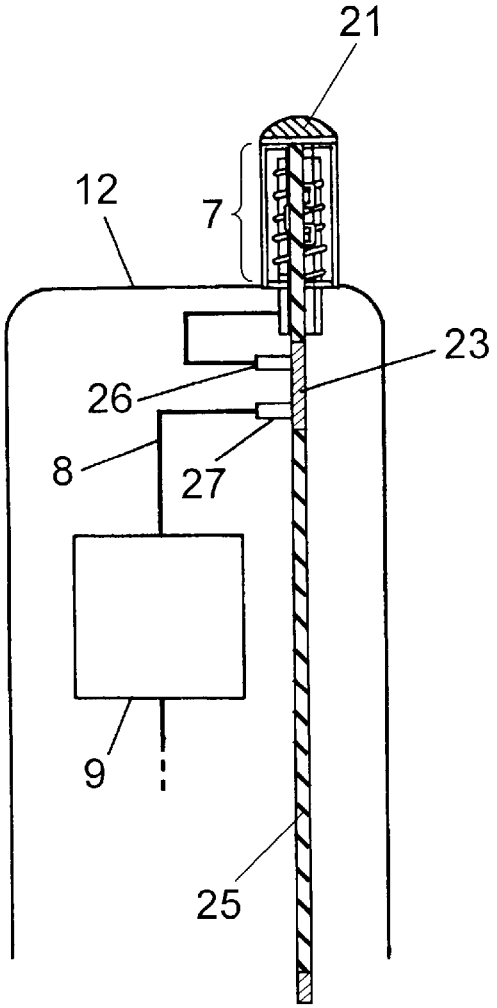
Figure 11D:
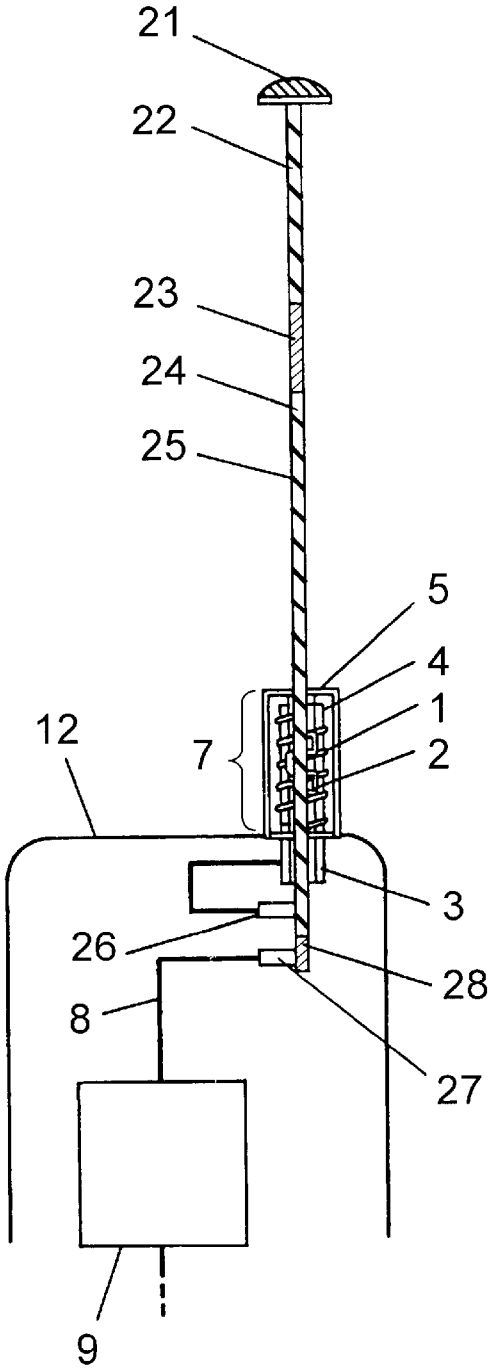

The first contact point 28 and a first feeding point 27 provided in the housing 12 are electrically connected, and signals are sent to the third antenna element 25 when it is pulled up as shown in FIGS. 11B and 11D. When the third antenna element 25 is stored as shown in FIGS. 11A and 11C, each of the first and second feeding points 27 and 26 is electrically connected with the second contact point 23. In this case, the first antenna device 7 functions as an antenna.

EIGHTH EXEMPLARY EMBODIMENT

Figure 12A:
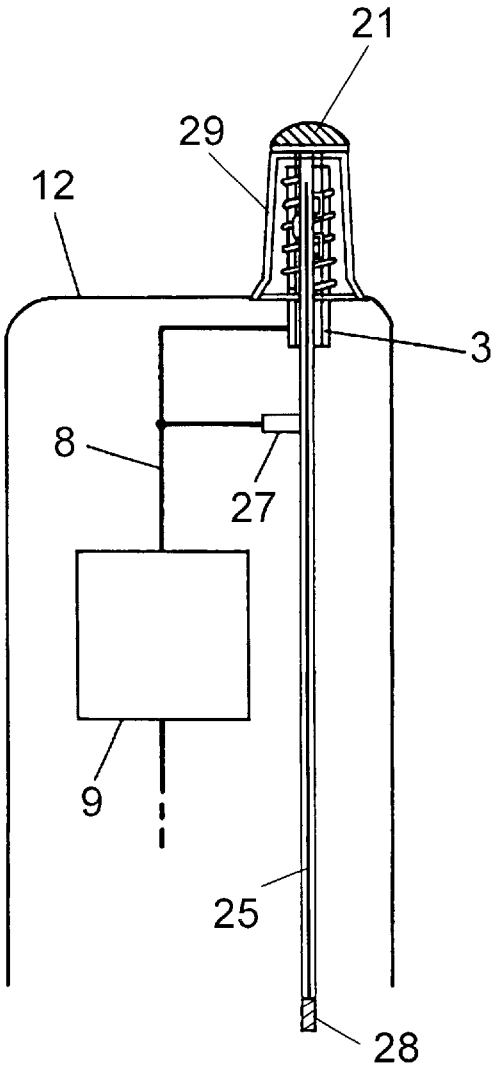
FIGS. 12A–12B show cross sections of a main part of an antenna device according to a eighth exemplary embodiment of the present invention.
Figure 12B:
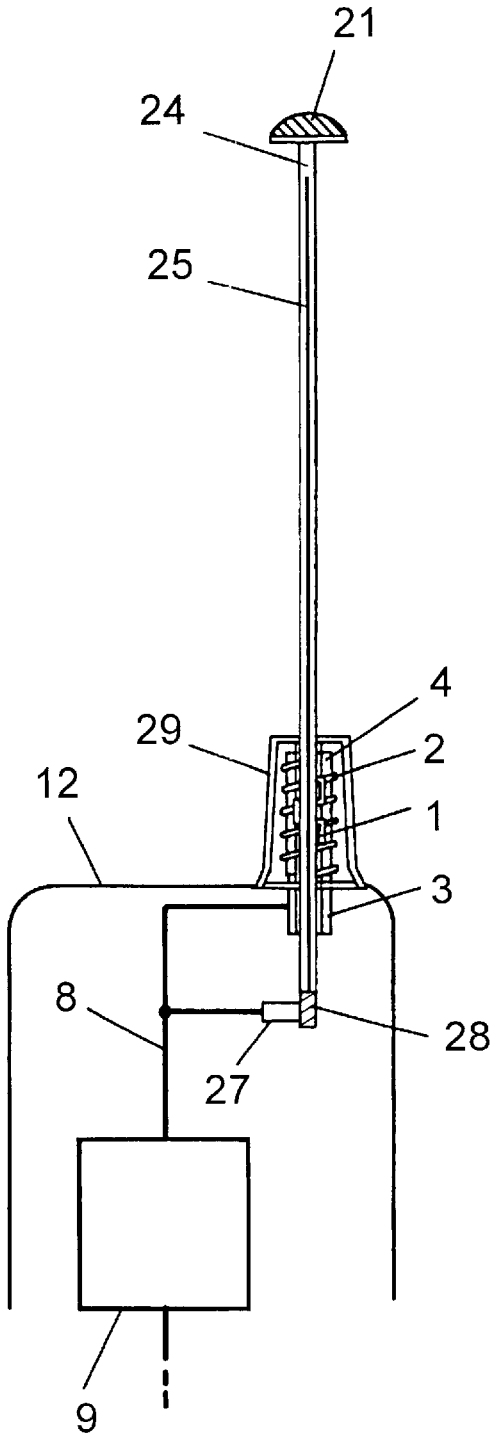

FIG. 12 shows a cross section of the antenna device of the eighth embodiment of the present invention. Differences from the seventh embodiment are as follows. The only contact point on the third antenna element 25 is the first contact point 28 provided at the bottom. The metallic plug 3 is electrically connected with the feeder line 8 inside the housing 12. A housing 29 integrally formed with the housing 12 has a function of the cap 5, and which has a hole on its top larger than the cross section of the third antenna element 25 expect for the top section 21 thereof. The hole allows the third antenna element 25 to be freely pulled up and stored.

When the third antenna element 25 is pulled up, the first contact point 28 and the first feeding point 27 are electrically connected, and electric signals are sent to both the first and third antenna elements 1 and 25. When the third antenna element 25 is stored, the first feeding point 27 contacts with the insulative body 24. Therefore, the signals are only sent to the first antenna element 1 and not to the third antenna element 25. In this case the first antenna device 7 functions as an antenna.

NINTH EXEMPLARY EMBODIMENT

Figure 13A:
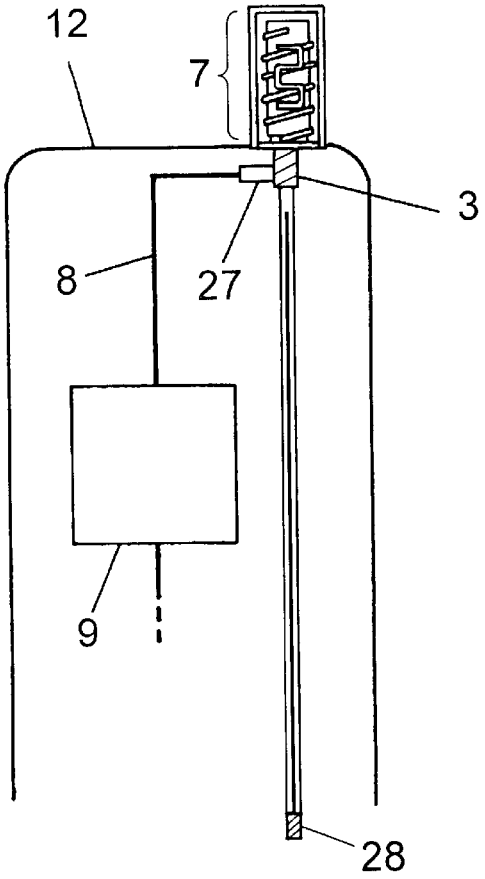
FIGS. 13A–13B show cross sections of a main part of an antenna device according to a eighth exemplary embodiment of the present invention.
Figure 13B:
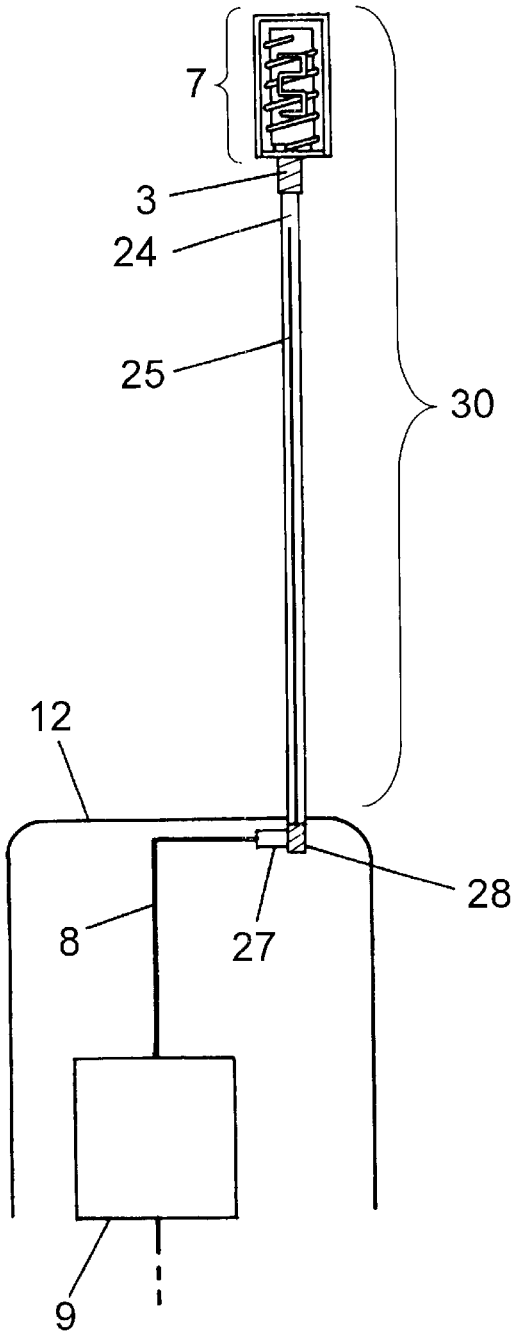
Figure 14:
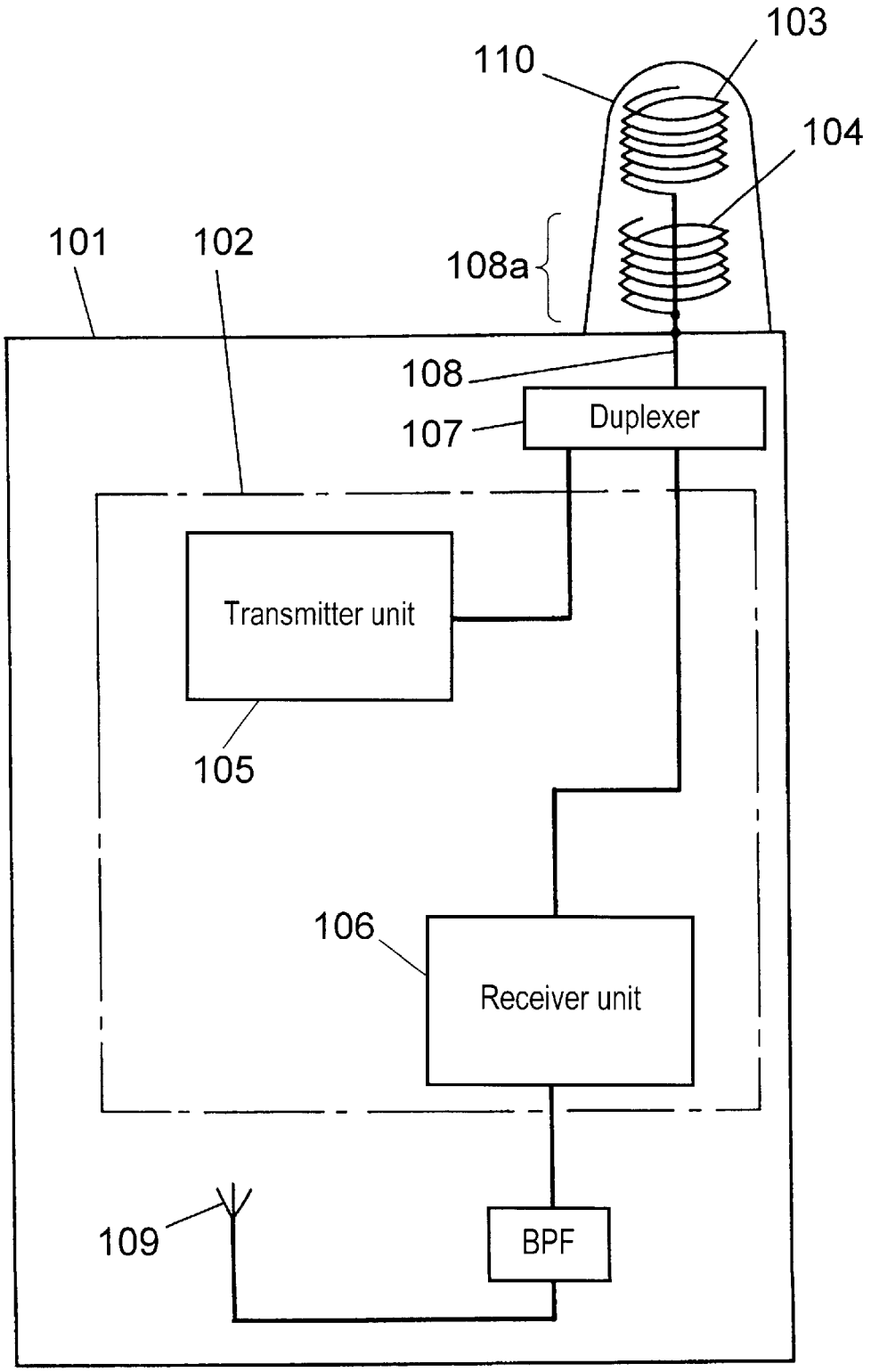
FIG. 14 PRIOR ART
FIG. 14 shows a schematic diagram of a conventional antenna device.

FIG. 13 shows a cross section of the antenna device of the ninth embodiment of the present invention. In this embodiment, the first antenna device 7 of the first embodiment is disposed on the third antenna element 25 via the metallic plug 3 to form a whip antenna 30. On the top of the housing 12 is a hole of which the diameter is set larger than the diameter of the metallic plug 3 so that the whip antenna 30 can be freely pulled up and stored. When the whip antenna 30 is pulled up, the first contact point 28 electrically contacts the first feeding point 27. The electric signals are sent to the bar-shaped third antenna element 25, thus only the third antenna element 25 functions as an antenna. When the whip antenna 30 is stored, the metallic plug 3 and the first feeding point 27 are electrically connected. The electric signals are sent only to the first antenna device 7, thus the first antenna device 7 functions as an antenna.

As thus far described, according to the present invention, antennas with good transmission and reception in at least dual frequency bands can be realized with simple constructions. The antennas achieve a wide range of impedance adjustment, and realize easy and low-cost production.

What is claimed is:

1. A dual frequency antenna device comprising;

a) a spiral-shaped first antenna element of which a first end is open and a second end is electrically coupled to a circuit; and b) a second antenna element having both ends being open, said second antenna element being insulated from said first antenna element, said second antenna element having a meandering shaped conductive section which changes direction more than two times;

wherein said first and said second antenna elements resonate respectively in a first frequency in a first frequency band and a second frequency in a second frequency band, the second frequency being higher than the first frequency, the meandering shaped conductive section of said second antenna element extending lengthwise parallel to a center axis of said spiral-shaped first antenna element.

2. The dual frequency antenna device as defined in claim 1, wherein said second antenna element is disposed at a predetermined position to obtain desired impedance properties.

3. The dual frequency antenna device as defined in claim 1, wherein at least one of said first and said second antenna elements are made of material containing at least one of silver, copper, beryllium copper, phosphor bronze, brass, aluminum, nickel and steel.

4. The dual frequency antenna device as defined in claim 1, wherein at least once of said first and said second antenna elements have a surface thereof plated with material containing at least one of silver, copper, beryllium copper, phosphor bronze, brass, aluminum, nickel and steel.

5. The dual frequency antenna device as defined in claim 1, wherein cross sections of said first and said second antenna elements are approximately circular or polygonal.

6. The dual frequency antenna device as defined in claim 1, wherein resin is situated between said first and said second antenna elements.

7. The dual frequency antenna device as defined in claim 1, wherein at least one of said first and said second antenna elements has insulation film on a surface thereof.

8. The dual frequency antenna device as defined in claim 1, wherein said first antenna element is molded with resin on an inner surface or an outer surface thereof, further, on the top of which, at least a portion of said second antenna element is plated.

9. The dual frequency antenna device as defined in claim 1, wherein a pattern of said second antenna element is plated on a film or flexible thin film resin, and which wraps and is fixed to an outer surface or an inner surface of said spiral-shaped first antenna element in such a manner that insulation between said first and said second antenna element is maintained.

10. The dual frequency antenna device as defined in claim 1, wherein a pattern of said second antenna element is formed with conductive paste on a film or flexible thin film resin, and which wraps and is fixed to an outer surface or an inner surface of said spiral-shaped first antenna element in such a manner that insulation between said first and said second antenna element is maintained.

11. The dual frequency antenna device as defined in claim 1, wherein said first and said second antenna elements are disposed inside of a housing of a communication terminal.

12. The dual frequency antenna device defined in claim 1, wherein said antenna device is included in a mobile communication apparatus.

13. An antenna device comprising;

a) a spiral-shaped first antenna element of which one end is open and the other end is electrically coupled to a circuit;

b) a second antenna element with both ends are open, and which is insulated from said first antenna element; and c) a third antenna element placed such that it can slide inside said first antenna element;

wherein electricity is supplied only to said third antenna element when said third antenna element is moved through said first antenna element in an upward position, and through said third antenna element, resonance occurs in the first and second frequency bands via a switch, and when the third antenna element is in a downward position, electricity is supplied only to said first antenna element, and through said first and said second antenna elements, resonance occurs respectively in the first and second frequency bands via the switch.

14. The dual frequency antenna device as defined in claim, wherein said third antenna element is constructed with a bar-shaped element.

15. The dual frequency antenna device as defined in claim 13, wherein said third antenna element is constructed with a spiral-shaped element.

16. The dual frequency antenna device as defined in claim 13, wherein said first and said second antenna elements are disposed inside of a housing of a communication terminal.

17. The dual frequency antenna device defined in claim 13, wherein said antenna device is included in a mobile communication apparatus.

18. The antenna device as defined in claim 13, wherein said second antenna element includes a meandering shape conductive section, said meandering shaped conductive section extending lengthwise parallel to a center axis of said spiral-shaped first antenna element.

19. An antenna device comprising:

a) a spiral-shaped first antenna element of which a first end is open and a second end is electrically coupled to a circuit;

b) a second element with both ends being open, said second antenna element being insulated from said first antenna element, said second antenna element having a meandering shaped conductive section, the meandering shaped conductive section of said second antenna element extending lengthwise parallel to a center axis of said spiral-shaped first antenna element; and c) a third antenna element placed such that it can slide inside said first antenna element;

wherein electricity is supplied only to said first and said third antenna elements when said third antenna element is in an upward position, and through said third antenna element, resonance occurs in the first and second frequency bands via a switch, and when said third antenna element is in a downward position, electricity is supplied only to said first antenna element, and through said first and said second antenna elements, resonance occurs respectively in the first and second frequency bands via the switch.

20. The dual frequency antenna device as defined in claim 19, wherein said third antenna element is constructed with a bar-shaped element.

21. The dual frequency antenna device as defined in claim 19, wherein said third antenna element is constructed with a spiral-shaped element.

22. The dual frequency antenna device as defined in claim 19, wherein said first and said second antenna elements are disposed inside of a housing of a communication terminal.

23. The dual frequency antenna device defined in claim 19, wherein said antenna device is included in a mobile communication apparatus.

24. An antenna device comprising;

a) a spiral-shaped first antenna element of which a first end is open and a second end is electrically coupled to a circuit;

b) a second antenna element with both ends being open, said second antenna element being insulated from said first antenna element, said second antenna element having a meandering shaped conductive section, the meandering shaped conductive section of said second antenna element extending lengthwise parallel to a center axis of said spiral-shaped first antenna element; and c) a third antenna element having said first and said second antenna element integrally formed on the top thereof, and which is placed such that it can slide inside a housing of a communication terminal;

wherein electricity is supplied only to said third antenna element when said third antenna element is in an upward position, and through said third antenna element, resonance occurs in the first and second frequency bands via a switch, and when said third antenna element is stored, electricity is supplied only to said first antenna element, and through said first and said second antenna elements, resonance occurs respectively in the first and second frequency bands via the switch.

25. The dual frequency antenna device as defined in claim 24, wherein said third antenna element is constructed with a bar-shaped element.

26. The dual frequency antenna device as defined in claim 24, wherein said third antenna element is constructed with a spiral-shaped element.

27. The dual frequency antenna device defined in claim 24, wherein said antenna device is included in a mobile communication apparatus.

28. A dual frequency antenna device comprising;

a) a spiral-shaped first antenna element of which a first end is open and a second end is electrically coupled to a circuit; and b) a second antenna element changing directions more than twice and comprising a conductive plate and having both ends being open, said second antenna element being insulated from said first antenna element;

wherein said first and said second antenna elements resonate respectively in a first frequency in a first frequency band and a second frequency in a second frequency band, the second frequency being higher than the first frequency.

29. The dual frequency antenna device as defined in claim 28, wherein said conductive plate is longer than a half of an outer or an inner periphery of said first antenna element.

30. The dual frequency antenna device as defined in claim 28, wherein said conductive plate comprises a hollow circular cylinder of which an inner diameter is larger than an outer diameter of said first antenna element, or an outer diameter is smaller than an inner diameter of said first antenna element.

* * * * *

UNITED STATES PATENT AND TRADEMARK OFFICE

CERTIFICATE OF CORRECTION

PATENT NO. : 6,388,625 B1
DATED : May 14, 2002
INVENTOR(S) : Fukushima et al.

It is certified that error appears in the above-identified patent and that said Letters Patent is hereby corrected as shown below:

Title page,
Item [56], References Cited, U.S. PATENT DOCUMENTS, delete "9/1996" and insert -- 2/1996 --.

Column 12,
Line 31, after the word "claim" insert the number -- 13 --.

Signed and Sealed this

Twenty-fourth Day of December, 2002

JAMES E. ROGAN
*Director of the United States Patent and Trademark Office*